United States Patent [19]

Zeisser

[11] Patent Number: 4,934,145

[45] Date of Patent: Jun. 19, 1990

[54] COMBUSTOR BULKHEAD HEAT SHIELD ASSEMBLY

[75] Inventor: Melvin H. Zeisser, Marlborough, Conn.

[73] Assignee: United Technologies Corporation, Hartford, Conn.

[21] Appl. No.: 256,443

[22] Filed: Oct. 12, 1988

[51] Int. Cl.[5] ..... F23R 3/02

[52] U.S. Cl. ..... 60/756; 60/740

[58] Field of Search ..... 60/740, 748, 752, 755, 60/756

[56] References Cited

U.S. PATENT DOCUMENTS

| | | | |
|---|---|---|---|
| 3,735,930 | 5/1973 | Mori | 60/740 |
| 3,853,273 | 12/1974 | Bahr et al. | 60/756 |
| 3,866,413 | 2/1975 | Sturgess | 60/748 |
| 3,899,884 | 8/1915 | Ekstedt | 60/737 |
| 3,901,446 | 8/1975 | Petreikis, Jr. et al. | 60/748 |
| 4,162,611 | 7/1979 | Caruel et al. | 60/756 |
| 4,180,974 | 1/1980 | Stenger et al. | 60/756 |
| 4,365,470 | 12/1982 | Matthews et al. | 60/756 |

FOREIGN PATENT DOCUMENTS

| | | | |
|---|---|---|---|
| 2173891 | 10/1986 | United Kingdom | 60/737 |

*Primary Examiner*—Louis J. Casaregola
*Assistant Examiner*—Timothy S. Thorpe
*Attorney, Agent, or Firm*—Troxell K. Snyder

[57] ABSTRACT

A segmented heat shield (36) is provided for an annular combustor bulkhead (20). The shield segments (38) define a backside cooling volume (44) which receives a flow of cooling air (66) for protecting the shield segment (38) from the high temperature combustion reaction (34). A region of extended heat transfer surface (68) on the shield backside (42) increases heat transfer effectiveness, while backside raised ridges (60, 62, 64) direct the cooling air (66) for achieving a more even distribution before being exhausted (50) adjacent the combustor liners (12, 14).

6 Claims, 2 Drawing Sheets

COMBUSTOR BULKHEAD HEAT SHIELD ASSEMBLY

FIELD OF THE INVENTION

The present invention relates to a gas turbine engine combustor.

BACKGROUND

Modern gas turbine engines may employ an annular combustor arrangement wherein a single combustion chamber is defined by an inner liner, a concentric outer liner, and an annular combustor head located at the upstream end of the combustion chamber with respect to the overall working fluid flow. One configuration of combustor head includes a generally torroidal shaped plenum volume defined by an upstream dome portion which further includes an opening for receiving a flow of compressed, relatively cool air, and a downstream bulkhead which also defines the upstream end of the annular combustion chamber, spanning the radial gap between the inner and outer combustor liners. The bulkhead also includes a plurality of openings, distributed circumferentially and aligned with the openings in the combustor head dome portion, for receiving a corresponding plurality of fuel nozzles discharging liquid or gaseous fuel into the combustion chamber. This type of combustor arrangement is generally well known, illustrated, for example., in U.S. Pat. No. 4,686,823.

As can easily be appreciated, the combustor head and liners encompass the highest temperature region of the engine, with gas temperatures reaching up to 2,000 F. (1,100 C.) and higher. The presence of the high temperature combustion reaction in the confined combustor volume requires protection of the surrounding structure, i.e., the inner and outer liner and the upstream bulkhead, so as to avoid over temperature of the adjacent engine structure which would require premature replacement or refurbishment.

With specific regard to the bulkhead, prior art methods of protecting this structure from the combustion reaction occurring immediately downstream within the interior of the combustor have included an enlarged protective flange secured to a guide bushing surrounding each individual fuel nozzle which extends parallel to the bulkhead for a distance and which directs a film of cooling air received from the combustor head plenum volume over the bulkhead surface. Drawbacks associated with this prior art method include a lack of uniformity in the protection achieved by the cooling air flow discharged at the edges of the nozzle guide flange, as well as a lack of protection from radiation heat flux from the combustion reaction through the film of cooling air to the bulkhead surface.

What is required is a positive, effective method of providing thermal protection to the combustion reaction facing side of the combustor bulkhead.

SUMMARY OF THE INVENTION

It is therefore an object of the present invention to provide a cooled heat shield for a combustor head in a gas turbine engine.

According to the present invention, an annular combustor head in a gas turbine engine is provided with a circumferentially segmented heat shield assembly for protecting the downstream bulkhead portion of the combustor head from the high temperature combustion reaction. The individual shield segments include means for accepting a flow of relatively cool compressed air received from an enclosed combustor head plenum volume via openings in the bulkhead, routing the cooling air between each shield segment and the corresponding circumferential portion of the bulkhead for cooling the shield segment.

The invention also provides a plurality of flow directing, raised ridges on the shield backside for defining a selected flow path for the cooling air. Another feature of the individual shield segments according to the present invention is the use of extended surface structures on the shield backside, such as pin fins or the like, for augmenting the heat transfer between the combustion facing surface of the heat shield and the backside cooling air flow.

Both these and other objects and advantages of the shield segment assembly according to the present invention will be apparent to those skilled in the art upon review of the following specification and the appended claims and drawing figures.

DETAILED DESCRIPTION OF THE PREFERRED EMBODIMENT

Figure 1:
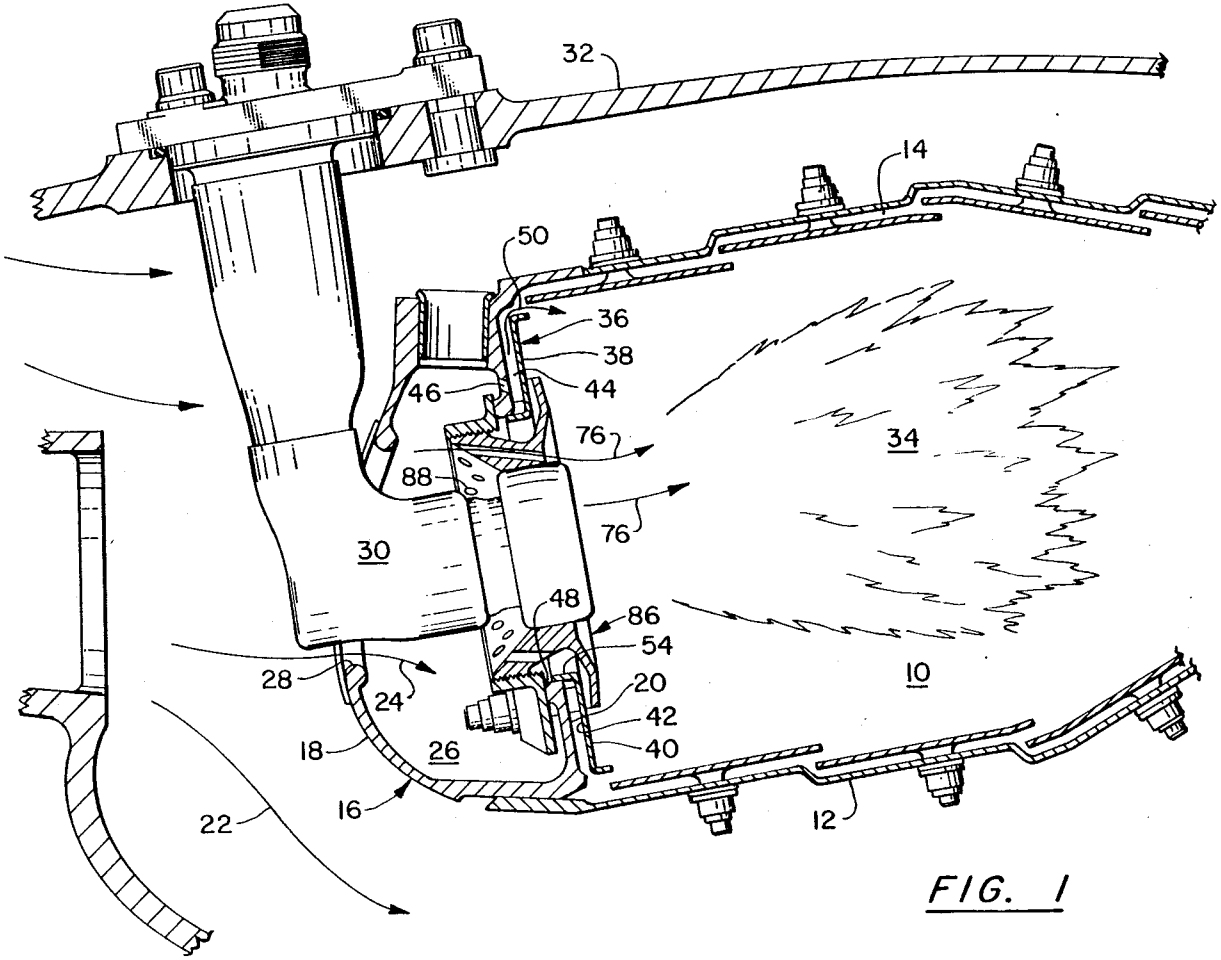
FIG. 1 shows a cross section of a portion of an annular combustion chamber having a combustor head and heat shield assembly according to the present invention.

FIG. 1 shows a cross section of the upstream end of an annular combustion chamber as may be used in a gas turbine engine, or the like. The combustion chamber 10 is defined by an annular inner liner 12 and a concentric, radially outer liner 14, and by an upstream combustor head 16 as shown. The combustor head 16 includes a dome portion 18 and a bulkhead portion 20, the bulkhead extending radially between the upstream edge of the inner liner 12 and the upstream edge of the outer liner 14. Relatively cool compressed air 22 flows from an upstream compressor section (not shown), with a portion 24 entering a plenum volume 26 formed between the dome 18 and bulkhead 20. The air 24 enters through a dome opening 28 which also receives a corresponding fuel nozzle 30. A plurality of such nozzles 30 and holes 28 are distributed circumferentially along the combustor head 16.

Each nozzle 30 is secured to the outer engine casing 32 and discharges liquid or gaseous fuel into the combustion chamber 10 for establishing a high temperature combustion reaction 34. As noted hereinabove, the bulkhead 20, if exposed to the high temperature combustion reaction 34 without protection, may be subject to overtemperature or other deleterious effects, and thus requires protection in the form of cooling or shielding.

Such shielding is accomplished according to the present invention by interposing a segmented annular shield 36 between the combustion chamber interior 10 and the bulkhead 20. The shield 36 is comprised of a plurality of individual segments 38, each segment circumferentially abutting two adjacent segments about the circumference of the annular bulkhead 20. Each segment 38 includes a generally planar, downstream facing surface 40 and an opposite, backside surface 42.

The shield segments 38 are exposed to the high temperature combustion products within the chamber interior 10 as well as any radiation heat transfer between the reaction 34 and the downstream facing surface 40. The shield, however, receives the benefit of both impingement and extended surface backside cooling as will be discussed hereinbelow in greater detail.

With further regard to FIG. 1, it must be noted that a portion of the air 24 entering the plenum volume 26 passes into a cooling volume 44 defined between the backsides 42 of the segments 38 and the downstream facing surface of the bulkhead 20 by means of flow openings 46 disposed in the bulkhead adjacent the corresponding nozzle receiving opening 48 therein. These openings 46 are sized to admit sufficient cooling air 24 from the plenum 26 into the cooling volume 44, with this backside cooling air 50 being discharged from the cooling volume 44 at the edges of the individual shield segments 38.

Figure 2:
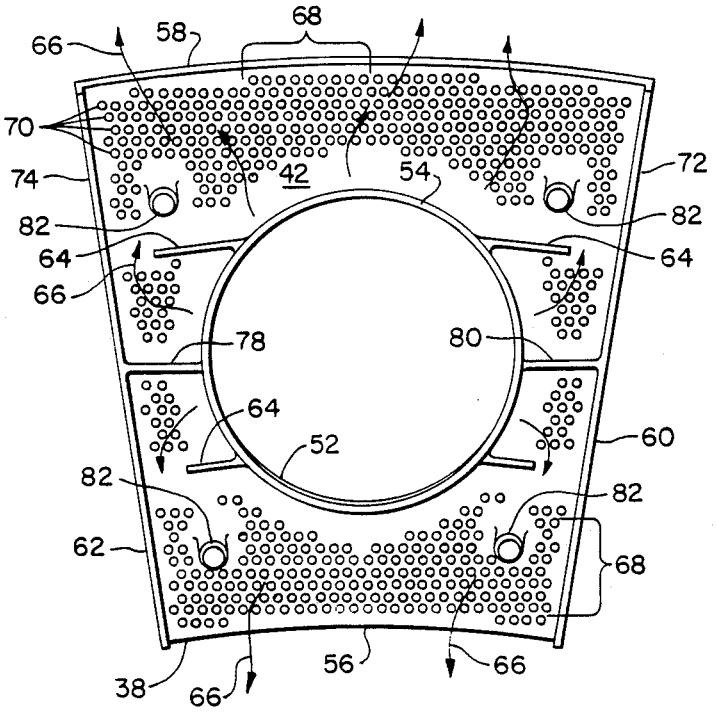
FIG. 2 shows a view of the backside of an individual shield segment according to the present invention.

FIG. 2 shows a view of the backside 42 of an individual heat shield segment 38 removed from the environment of FIG. 1. Each individual segment 38 includes a central opening 52 for receiving the fuel nozzle 30 therethrough, the opening 52 including an annular spigot 54 extending upstream and fitting closely within the corresponding opening 48 in the bulkhead 20. The segment 38 is sector shaped, with a radially inner edge 56, a radially outer edge 58, and lateral edges 60, 62 which abut circumferentially adjacent shield segments (not shown) of the assembly.

The segment 38 according to the present invention also includes a plurality of raised ridges 64 secured to the backside 42 and extending into contact with the downstream face of the bulkhead 20 when installed. These ridges 64 direct the flow of a portion of the cooling air entering the cooling volume 44 via the cooling holes 46 insuring a more even distribution over the entire segment backside 42. The cooling holes 46 (not shown in FIG. 2) are generally disposed adjacent the nozzle opening 48 in the bulkhead 20, thereby discharging the cooling air into the cooling volume 44 adjacent the segment spigot 54. This cooling air impinges on the plate backside 42 in the vicinity of the spigot 54, thus providing sufficient local cooling for this region of the segment 38. The flow of cooling air in the volume, identified by reference numeral 66, is directed by the raised ridges 64 to flow outward with respect to the segment spigot 54, whereupon the cooling air 66 enters a region of extended surface 68 which include, for example, a plurality of individual pin fins 70 extending from the segment backside 42. The extended surface region 68 provides highly effective heat transfer between the plate backside 42 and the flow of cooling air 66, thus protecting the downstream facing side 40 (not shown in FIG. 2) of the segment 38.

It is further a feature of the segment according to the present invention to provide raised ridges 72, 74 coincident with the lateral edges 60, 62 of the individual segment for effectively blocking the flow of cooling air 66 from being exhausted into the combustion chamber 10 between adjacent segments 38. Thus, all the cooling air 66 flowing in the volume 44 is preferentially exhausted at the ID and OD edges 56, 58 of each segment 38. The discharged cooling air 50 thus enters the chamber 10 providing a film of cooling air at the upstream edges of the inner and outer combustor liners 12, 14 and does not directly mix with the combustion air 76 and fuel in the combustion region 34.

It is still further a feature of the segment 38 according to the present invention to provide circumferentially extending ridges 78, 80 extending from the spigot 54 to the lateral ridges 72, 74 for radially dividing the flow of cooling air 66 between the radially outer portion of the segment 38 and the radially inner portion thereof. Radial placement of the circumferential dividing ridges 78, 80 apportions the overall mass flow of cooling air 66 between the segment OD 58 and ID edge 56.

As may further be appreciated by viewing FIG. 2, the placement and distribution of the individual pin fins 70 or other extended surface provides additional means for controlling the flow uniformity of the cooling gas 66 traversing the cooling volume 44.

The individual segments 38 are secured to the bulkhead 60 by means of threaded posts 82 which are integrally formed with the individual segments 38 according to the preferred embodiment of the present invention. The posts 82 are received within corresponding holes (not shown) in the bulkhead 20 and secured by a nut 84 or other well known securing means.

FIG. 1 also shows the use of a nozzle guide structure 86 interposed between the nozzle 30 and the shield 38 and bulkhead 20. The guide 86 is well known in the art and includes a plurality of combustion air admitting openings 88 for directing and controlling the flow of combustion air 76. It is a feature of the shield assembly 36 according to the present invention to present a planar, downstream facing surface 40 similar to that of the unshielded bulkhead 20, thereby allowing the use of nozzle guides 86 relatively unmodified as compared to nozzle guide used with prior art, partially shielded combustor bulkheads.

It must further be appreciated that the embodiment disclosed herein is but one of a plurality of equivalent structures which fall within the scope of the present invention which is, in turn, defined only by the limitations present in the claims presented hereinbelow.

I claim:

1. In a gas turbine engine having an annular combustion chamber defined by an annular, inner liner, a concentric outer liner, and an upstream annular combustor head, wherein the head includes a radially extending bulkhead having a plurality of circumferentially distributed openings for each receiving an individual fuel nozzle therethrough, the improvement comprising:

a segmented heat shield assembly, disposed between the combustion chamber interior and the bulkhead, including a plurality of generally planar, sector shaped heat shields, each shield abutting circumferentially with two next adjacent shields and extending radially from proximate the inner liner to proximate the outer liner, the plurality of shields collectively defining an annular protective barrier, and wherein each sector shaped shield further includes an opening, corresponding to one of the bulkhead nozzle openings for likewise receiving the corresponding nozzle therethrough, the shield opening further including an annular lip extending toward the bulkhead and being received within the bulkhead opening, a plurality of raised ridges on the shield backside, the ridges contacting the facing bulkhead surface and defining a flow path for a flow of cooling air issuing from a sized supply opening disposed in the bulkhead, said flow path running ultimately from adjacent the annular lip to the edges of each shield segment, wherein the raised edges extend fully along the lateral, circumferentially spaced edges of each shield segment and abut the adjacent shield segments, thereby directing the flow of cooling gas to the radially inward and radially outward edges of the individual shield segments, and wherein the raised ridges further extend circumferentially between the annular lip and the abutting edge ridges for apportioning the flow of cooling gas between the radially inner portion of the shield and the radially outer portion of the shield.

2. The heat shield assembly as recited in claim 1, wherein the shield segments each further include means, located in the cooling air flow path, for augmenting the transfer of heat energy between the shield backside and the cooling air.

3. The heat shield assembly as recited in claim 2 wherein the augmenting means includes extended surface structures projecting from the backside of the shield segments into the cooling gas flow path.

4. The shield assembly as recited in claim 3 wherein the extended surface structure is a plurality of pin fins, integral with the shield segment.

5. The shield assembly as recited in claim 1, further comprising means for securing the shield segments to the bulkhead.

6. The shield assembly as recited in claim 5, wherein the securing means includes a threaded post extending from the shield backside through a corresponding bolt hole in the bulkhead, and an internally threaded nut means adapted to engage the threaded post.

* * * * *